US007387263B2

(12) United States Patent
Yasukawa et al.

(10) Patent No.: US 7,387,263 B2
(45) Date of Patent: Jun. 17, 2008

(54) FUEL INJECTION VALVE OF ENGINE, FUEL INJECTION METHOD AND ASSEMBLING METHOD OF THE SAME

(75) Inventors: Yoshihito Yasukawa, Chiyoda (JP); Noriyuki Maekawa, Chiyoda (JP); Takehiko Kowatari, Kashiwa (JP); Yoshio Okamoto, Minori (JP)

(73) Assignee: Hitachi, Ltd., Tokyo (JP)

( * ) Notice: Subject to any disclaimer, the term of this patent is extended or adjusted under 35 U.S.C. 154(b) by 314 days.

(21) Appl. No.: 11/043,081

(22) Filed: Jan. 27, 2005

(65) Prior Publication Data

US 2006/0027217 A1 Feb. 9, 2006

(30) Foreign Application Priority Data

Aug. 6, 2004 (JP) ..... 2004-230091

(51) Int. Cl.
*F02D 1/06* (2006.01)
*B05B 1/24* (2006.01)
*F02M 61/00* (2006.01)

(52) U.S. Cl. ..... 239/5; 239/13; 239/128; 239/135; 239/472; 239/491; 239/533.12; 239/585.1; 123/549

(58) Field of Classification Search ..... 239/5, 239/13, 491, 88–93, 128, 133, 135, 139, 239/463, 490, 472, 533.2, 533.12, 585.1–585.5; 251/129.21; 123/543, 549, 557, 558; 222/146.5
See application file for complete search history.

(56) References Cited

U.S. PATENT DOCUMENTS

| | | | | |
|---|---|---|---|---|
| 5,207,384 | A * | 5/1993 | Horsting | 239/463 |
| 5,915,626 | A * | 6/1999 | Awarzamani et al. | 239/135 |
| 6,135,360 | A * | 10/2000 | Ren et al. | 239/136 |
| 6,422,481 | B2 * | 7/2002 | Ren et al. | 239/13 |
| 6,748,872 | B2 * | 6/2004 | Parrish | 123/305 |
| 2003/0121999 | A1 | 7/2003 | Huebel | |

(Continued)

FOREIGN PATENT DOCUMENTS

EP 0 693 623 A1 1/1996

(Continued)

OTHER PUBLICATIONS

European Search Report dated Dec. 12, 2005 (four (4) pages).

*Primary Examiner*—Davis D Hwu
(74) *Attorney, Agent, or Firm*—Crowell & Moring LLP

(57) ABSTRACT

The heating injector in which the fuel is heated within a short time when starting and the size of a fuel atomized particle is very small h as casing 10 for a fuel injection valve which supplies fuel to an engine, orifice member 50 with an orifice through which fuel passes, plunger 20 which carries out switching action of orifice, swirl chip 30 which contacts the orifice member and the casing at a plurality of positions, and forms a fuel passage blocked by a plurality of narrow portions and a fuel heating space channel where entrance side was blocked by the narrow portion in the downstream side, and a heater which is arranged between fuel passage forming member and casing and supported by either of the fuel passage forming member or the casing in a plurality of parts in the fuel passage.

8 Claims, 10 Drawing Sheets

U.S. PATENT DOCUMENTS

| | | | |
|---|---|---|---|
| 2003/0192960 | A1 | 10/2003 | Guettler et al. |
| 2004/0261761 | A1 | 12/2004 | Hayakawa et al. |

FOREIGN PATENT DOCUMENTS

| | | | |
|---|---|---|---|
| JP | 2000-230465 | | 8/2000 |
| JP | 2000 230465 | A | 8/2000 |
| JP | 2003-314402 | | 11/2003 |
| WO | WO 99/05411 | | 2/1999 |

* cited by examiner

FUEL INJECTION VALVE OF ENGINE, FUEL INJECTION METHOD AND ASSEMBLING METHOD OF THE SAME

The present application claims priority from Japanese application JP2004-230091 filed on Aug. 6, 2004, the content of which is hereby. incorporated by reference into this application.

BACKGROUND OF THE INVENTION

The present invention relates to a fuel injection valve used for an engine, a method of fuel injection to an engine, and an assembly method of the fuel injection valve.

For instance, a fuel injection valve which injects the fuel after heating the fuel injected from the fuel injection valve is disclosed in Japanese Patent Application Laid-Open No. 2000-230465 and Japanese Patent Application Laid-Open No. 2003-314402. The fuel injection valve described in Japanese Patent Application Laid-Open No. 2000-230465 forms a plurality of fuel passages in order to change the shape of spray, and heats the fuel which flows in the fuel passage selected from among a plurality of fuel passages with the heater. In the invention of Japanese Patent Application Laid-Open No. 2003-314402, heating wire has been wound around a movable needle valve.

However, the heater is arranged to contact the casing in the technology of Japanese Patent Application Laid-Open No. 2000-230465. Therefore, a part of heat from the heater is transferred to the casing when heating of the fuel is tried at the starting point of time, and the heating efficiency of the fuel is deteriorated. Therefore, the heating time becomes long and there is a possibility that the electric power consumption additionally increases, too.

Moreover, the passage is separated to a plurality of ones, and a heater is arranged in the passage selected from among them. Therefore, there is a passage where the heater is not provided for either. After all, only a part of the fuel to be injected is heated, and the atomization of the entire fuel to be injected might not be promoted.

By the way, it is more advantageous to promote the atomization of the fuel to burn the fuel easily as much as possible, in order to improve the starting characteristic of the engine and to decrease the harmful exhaust gas. In general, it is about 0.5 seconds and little time until the key is turned on when the engine is about to be started and the cranking is begun, and the injection of the fuel for the starting is begun. Ignitability can be improved when the atomization of the fuel is performed at that time and the emission of unburnt hydrocarbon (HC) can be decreased especially. Moreover, the electric power consumption of a starter is large at the cranking, and the power electric load to the battery is large during that time. Therefore, when the equipment by which the electric power is consumed is operated, making to the power saving is especially requested. Therefore, an electric heater which heats the fuel must increase efficiently the temperature of the fuel within a short time.

In Japanese Patent Application Laid-Open No. 2003-314402, the heating wire wound around the needle valve warms up the entire needle valve. As a result, the fuel in the entire surroundings of the long needle valve is heated. Therefore, an essential start ability might worsen, because power consumption increases, and an extra load not only is applied to the battery, but also the power supply to the starter decreases.

BRIEF SUMMARY OF THE INVENTION

A first object of the present invention is to provide a heating type fuel injection valve which can raise the temperature of fuel with a small electric power and within a short time when starting.

A second object of the present invention is to simplify the structure of the heating type fuel injection valve, and facilitate its assembly.

A third object of the present invention is to provide a method of injecting the fuel of which temperature is raised efficiently into the engine immediately.

A fourth object of the present invention is to provide a method of assembling easily the above-mentioned fuel injection valve.

To achieve the object, a heating type fuel injection valve comprising a casing for the fuel injection valve which supplies fuel to an engine, an orifice member provided in the casing and having an orifice which the fuel passes through, a plunger provided in the casing, which opens or shuts said orifice, a fuel passage forming member which contacts said orifice member and the casing, and forms a plurality of fuel passages, and a fuel heating space channel having a heater in the fuel passage, which is blocked in a narrow portion and arranged between the fuel passage forming member and the casing.

In addition, the heater supported at a plurality of positions of either of said fuel passage forming member or said casing is provided in such a heating type fuel injection valve.

As another feature, the capacity of fuel passage formed with the fuel passage forming member and the casing is substantially equal to or smaller than the capacity of the fuel injection amount required to one combustion in the engine.

Preferably, the fuel passage forming member which has the function for swirling the injection fuel at an injection port is provided in a fuel injection valve.

When assembling the valve, it is preferable to install it in said housing after said fuel passage forming member and said heater are combined beforehand.

Concretely, the present invention relates to a fuel injection valve for an engine comprising a casing, an orifice member provided in the casing to form an orifice through which the fuel passes, a plunger which opens or shuts said orifice, and a member provided in said casing to oppose to said casing, which contacts said orifice member, and forms a fuel passage along said casing. Further, said casing or said fuel passage forming member have a narrow portion which narrows the fuel passage on an entrance side of said fuel passage, a fuel heating space channel where the entrance side was blocked is formed with the narrow portion in said fuel passage excluding a narrow portion passage, and a heater is provided in the fuel heating space channel.

In the present invention, the heater is set up inside of the blocked fuel heating space channel formed with the narrow portion provided on the entrance side. Therefore, the fuel of a constant amount which exists in the predetermined capacity can be heated. As a result, the fuel can be heated effectively and promptly. Because the capacity of the fuel heating space channel can be adjusted by adjusting the length of the narrow portion, an amount of one fuel injection given to the engine can be easily set. Moreover, because the fuel of the limited amount is heated, it is possible to heat effectively and promptly. As a result, the atomization of the fuel at the engine starting can be effectively carried out.

A fuel amount which corresponds to one combustion is heated, and it is not required to heat an extra amount of the fuel. Therefore, the electric power consumption can be decreased, and the fuel can be heated at high speed. In addition, the controllability when the heating is discontinued/restarted is improved because one combustion amount of the fuel is heated every time.

Even at starting when the fuel pressure is low and the effect of the swirl is small, the fuel is atomized by the function of the fuel passage forming member with the effect of the swirl and the heating. Moreover, even if the heating action is not used enough after starting, the fuel is atomized enough by the fuel passage forming member with the effect of the swirl. As a result, the electric power consumption can be decreased.

The heat transmission from the heater to the fuel increases because the flow of the fuel is arranged by the narrow portion, the speed of the fuel increases, and then the fuel is introduced into the heater.

A fragile heater will be protected by the assembly method and assembly becomes easy. In addition, because th e outermost diameter of the fuel passage forming member increases more than the outermost diameter of the heater, the fuel passage forming member acts as a protection member, and the assembly becomes easy further.

BRIEF DESCRIPTION OF THE SEVERAL VIEWS OF DRAWINGS

The present invention will be understood more fully from the detailed description given hereinafter and from the accompanying drawings of the preferred embodiment of the present invention, which, however, should not be taken to be limitative to the invention, but are for explanation and understanding only.

DETAILED DESCRIPTION OF THE INVENTION

Figure 1:
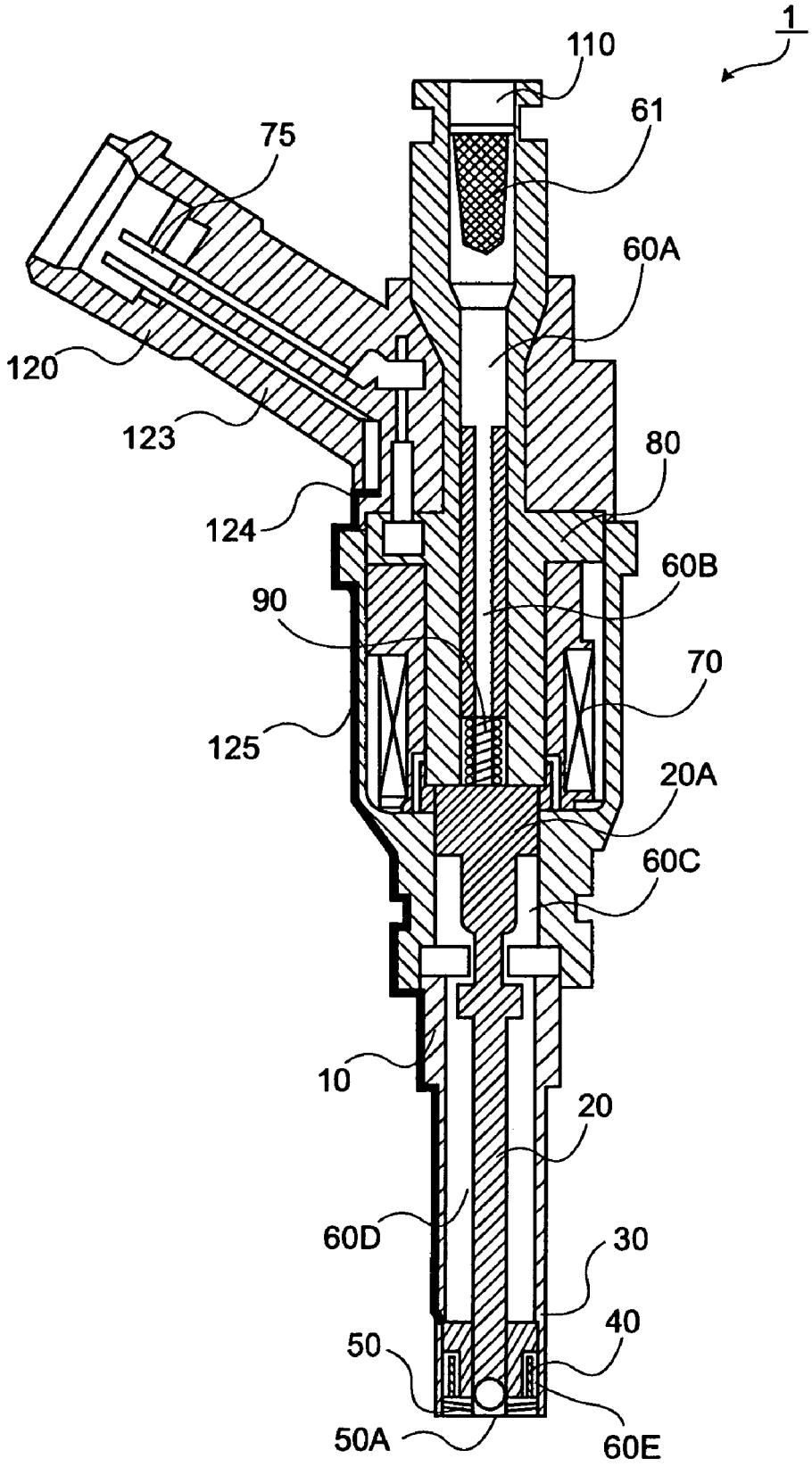
FIG. 1 is a schematic view of a fuel heating type fuel injection valve according to the present invention.

The present invention will be discussed hereinafter in detail in terms of the preferred embodiment according to the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscurity of the present invention.

According to an embodiment of the present invention, a fuel injection valve for an engine comprises a casing, an orifice member provided in the casing to form an orifice through which the fuel passes, a plunger which opens or shuts the orifice, and a member provided in the casing to oppose to the casing, which contacts the orifice member, and forms a fuel passage along the casing. Wherein the casing or the fuel passage forming member have a narrow portion which narrows the fuel passage on an entrance side of the fuel passage, a fuel heating space channel where the entrance side was blocked is formed with the narrow portion in the fuel passage excluding a narrow portion passage, and a heater is provided in the fuel heating space channel. Further, the heater is provided in the fuel heating space channel so as to come from the surface of the member which forms the casing and the fuel passage to the surface.

Preferably, the narrow portion has a circumference part to narrow the fuel passage over its periphery and a convex part provided at a plurality of positions of a circumference part to contact the casing.

Preferably, the narrow portion has a circumference part to narrow the fuel passage over its periphery and a convex part provided at a plurality of positions of a circumference part to contact the opposing part, and wherein the heater is penetrated to the hole or slot provided in the convex part, and supported.

Another embodiment of the present invention relates to a fuel injection method for an engine using a fuel injection valve for an engine comprising a casing, an orifice member provided in the casing to form an orifice through which the fuel passes, a plunger which opens or shuts the orifice, a member provided in the casing to oppose to the casing, which contacts the orifice member, and forms a fuel passage along the casing, and a fuel heating space channel formed in the fuel passage, which has the capacity which corresponds to one shot of the fuel injection to the engine and of which the entrance side is blocked by a narrow portion provided in the casing or the fuel passage forming member to narrow the fuel passage in an entrance part of the fuel passage. Wherein the fuel heated by the heater provided in the fuel heating space channel is supplied and injected into the engine.

Preferably, a fuel injection method for an engine using a fuel injection valve for an engine, wherein the capacity of the fuel heating space channel is adjusted by adjusting the length of the passage of the narrow portion.

A further embodiment relates to an assembly method of a fuel injection valve for an engine including a casing, an orifice member provided in the casing to form an orifice through which the fuel passes, a plunger which opens or shuts the orifice, and a member provided in the casing to oppose to t he casing, which contacts the orifice member, and forms a fuel passage along the casing, comprising the steps of forming an edge of the casing as an open end, forming a penetration hole in a part of the casing, forming a narrow portion which narrows a fuel passage on the entrance side of the fuel passage in the member which forms the fuel passage, forming a fuel heating space channel of which the entrance side is blocked by the narrow portion excluding a narrow portion passage, providing a heater to the member which forms the fuel passage so that the heater may be located internally in the fuel heating space channel, penetrating a wiring for the heater to the penetration hole provided in the casing, inserting and fixing the member which forms the fuel passage from the open end of the casing into the casing, and inserting the orifice member from the open end into the casing so that the orifice member may contact the member which forms the fuel passage, fixing the orifice member to the casing, blocking up the penetration hole, the fuel passage provided with the narrow portion passage and fuel heating space channel being formed between the casing and the member which forms the fuel passage.

EMBODIMENT

FIG. 1 shows an embodiment of the present invention characterized by the fuel heating heater.

The heating type fuel injection valve 1 shown in FIG. 1 has casing 10, orifice member 50, plunger 20 which opens and shuts orifice, swirl chip 30 contacted casing 10 and orifice member 50 to form fuel passages 60A to 60E between them, which acts as fuel passage forming member, heater 40 which heats fuel. The fuel injection valve further includes electromagnetic coil 70 which drives the plunger, electromagnetic coil drive electrode 75 which is a part of electric wiring by which electric current is supplied to electromagnetic coil 70, inner side fixation core 80 which is a part of magnetic path formed by electromagnetic coil 70, coil spring 90 which energizes in a direction where plunger 20 is pressed against orifice member 50, driving terminal 120 for a heater which is a part of circuit which supplies an electric power to heater 40, a resin molding 123, and wiring 125 to heater 40 which heats fuel.

The fuel is pressurized by a fuel pump (not shown), and introduced from fuel inlet 110 of the fuel injection valve through a fuel piping (not shown). Then, it passes filter 61 for the foreign particle removal, and goes to fuel passage 60C through fuel passages 60A and 60B and fuel passing hole (not shown) in the upper part 20A of the plunger. Then, the fuel is heated in fuel passage 60E after passing through fuel passages 60D and 60E, and injected from the injection hole 50A of orifice member 50.

The fuel is injected by energizing electromagnetic coil drive electrode 75. The electric current flows to electromagnetic coil 70 by energizing it, and the attraction is generated in plunger 20 usually seated on orifice member 50. The orifice opens when the attraction exceeds the suppression power by coil spring 90, and plunger 20 moves to the side of an inside fixation core 80. Electromagnetic force becomes weak when the energizing to an electromagnetic coil is interrupted, the plunger returns to the former position by coil spring, and the injection is stopped.

Heater 40 is energized from driving terminal 120 for the heater. Heater 40 is heated by a current flowing to it through wiring 125 or the outside of the heating type fuel injection valve. It is composed by wiring 125 and casing hole 121 which goes out of heater 40.

Heater 40 is an electric heat heater of the Nichrome wire type in this example. The temperature rise time can be speeded up further by using the Nichrome wire because of no extra heat capacity. Even if it is a Nichrome wire type heater with insulation coating film for insulation, the reliability and the durability is improved without dropping the effect of the temperature rise because the insulation coating is thin in general. The temperature control circuit becomes unnecessary with PTC heater (Positive Coefficient Ceramic Heater) which makes 200° C. a temperature limit for the power supply voltage of the heater and thereby it is possible to simplify further compared with the Nichrome wire.

Figure 2:
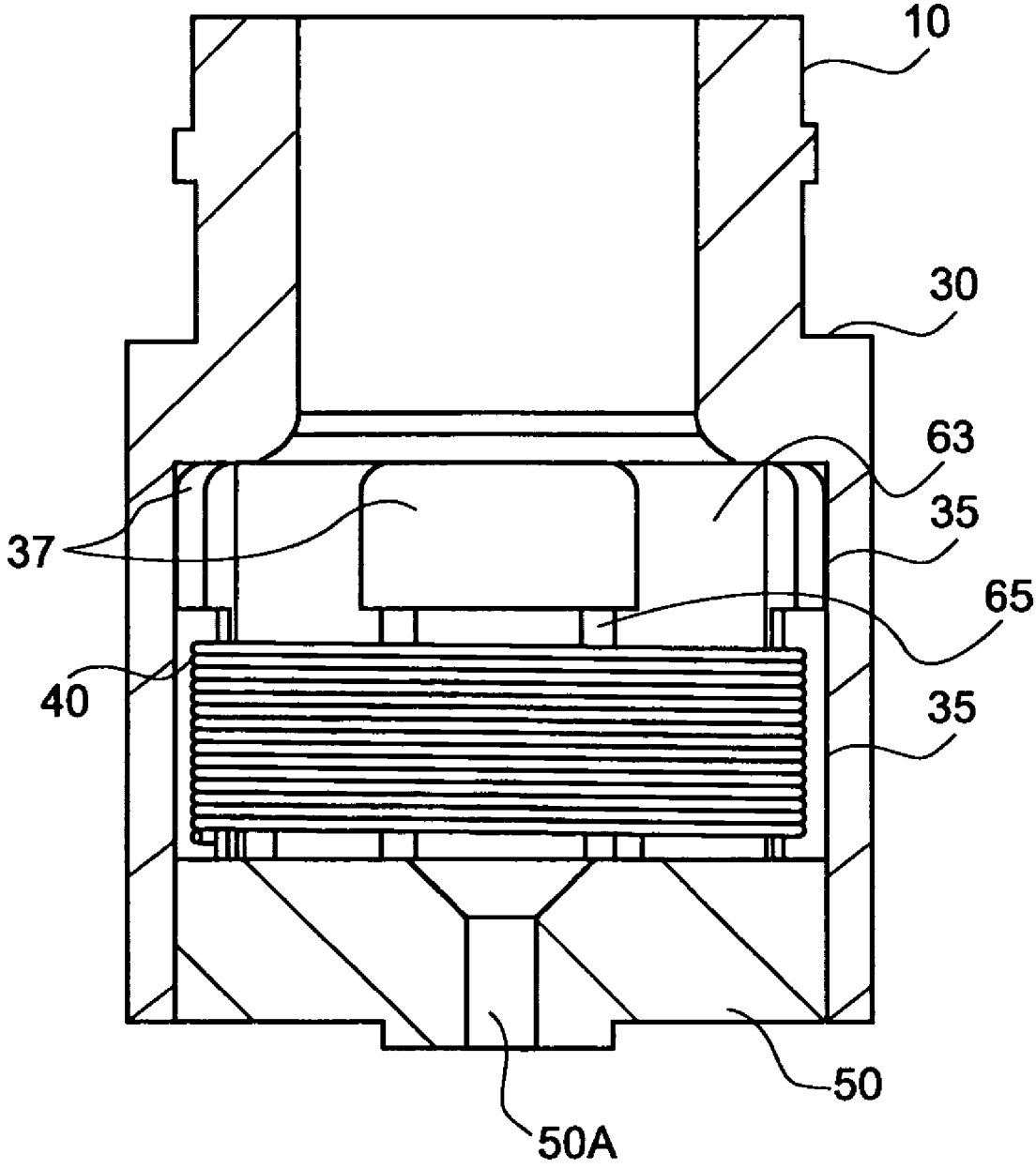
FIG. 2 is an enlarged view showing a point of fuel injection valve of FIG. 1.
Figure 3:
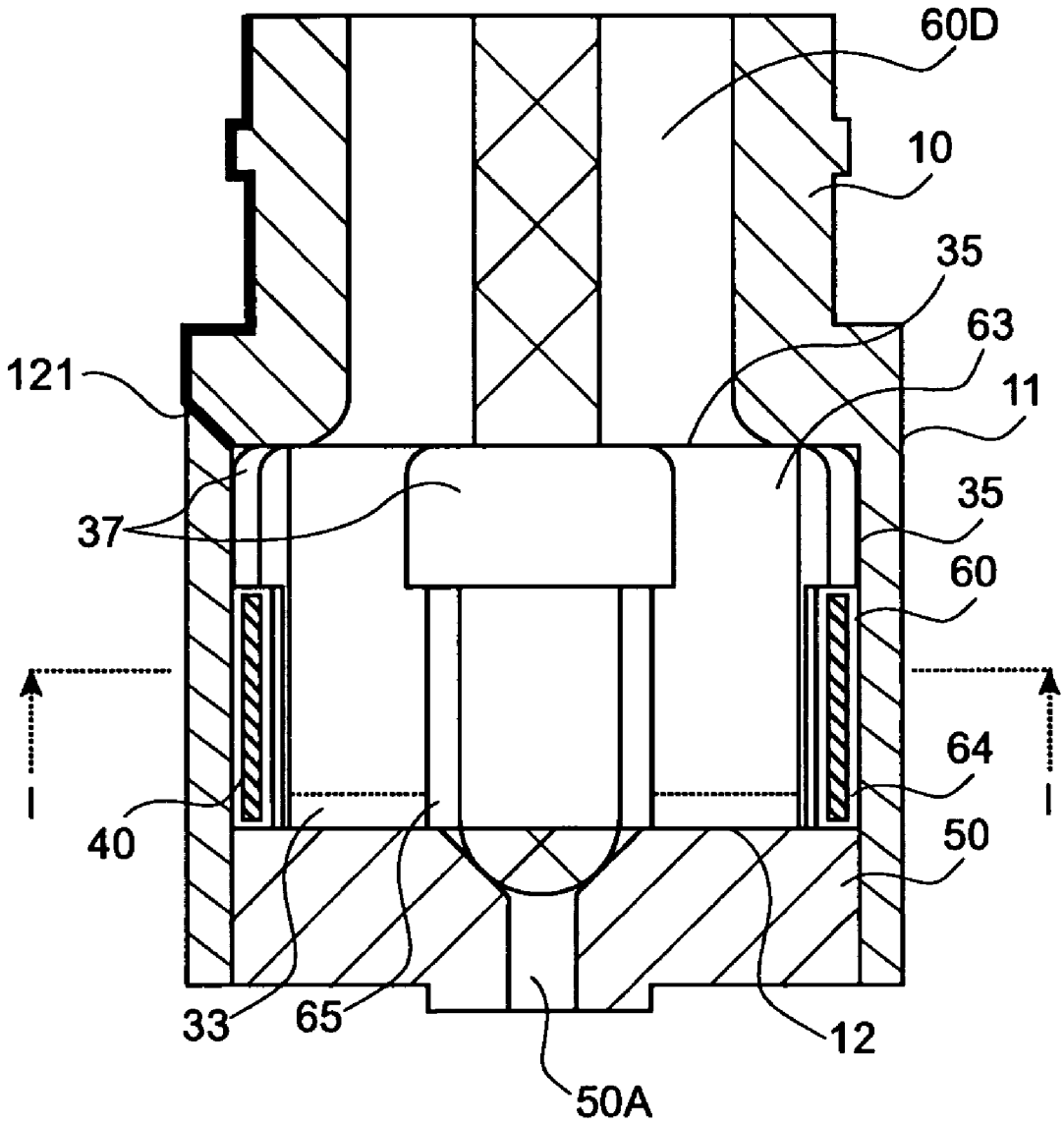
FIG. 3 is a block diagram of the point, which includes a partial section of fuel injection valve of FIG. 2.
Figure 4:
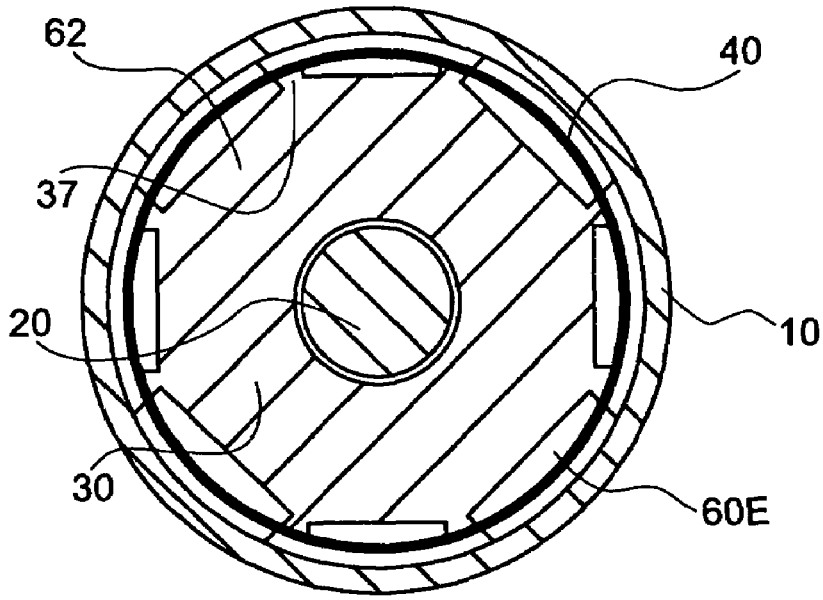
FIG. 4 is a view in I-I section in FIG. 2.
Figure 5:
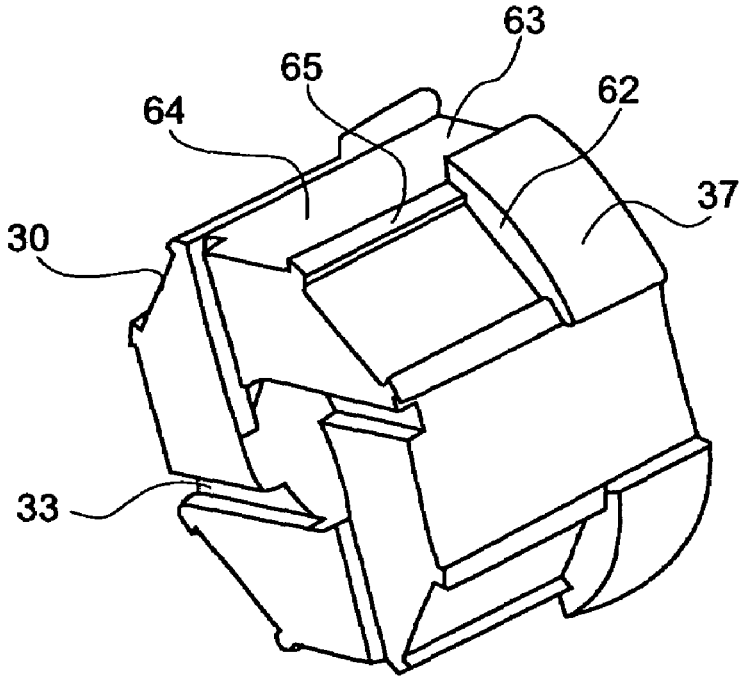
FIG. 5 is a perspective view showing the composition of a swirl chip.
Figure 6:
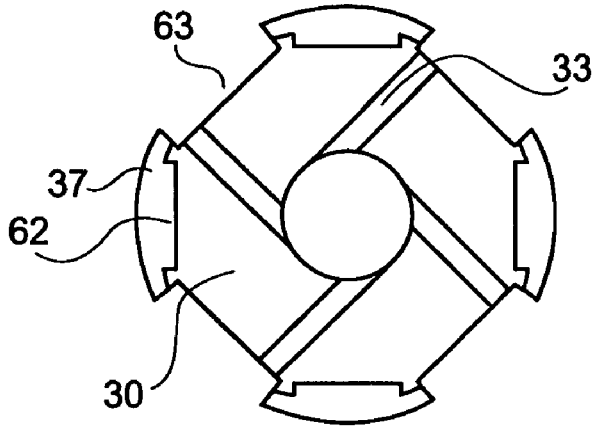
FIG. 6 is a view showing the details of swirl element.

FIG. 2 is an enlarged view of the point of fuel injection valve 1 of the heating type shown in FIG. 1. FIG. 3 is an enlarged view of the point of fuel injection valve 1 which includes a partial section of FIG. 2. FIG. 4 is an I-I sectional view of FIG. 3. FIG. 5 is a perspective view of swirl chip 30 used for fuel injection valve 1. And, FIG. 6 is a view where FIG. 5 was seen from the lower side.

Swirl chip 30 is arranged in space part 12 of point 11 of casing 10 in these figures. Narrow portion 35 which has vertical length in figure is provided on the top side of the space part, that is, the fuel inflow side, and fuel passage 60 is narrowed. This narrow portion 35 has circumference part 62 by which fuel passage 60 is narrowed over the periphery. Convex part 37 which reaches casing 10 is provided at eight positions of circumference part 62 (It may be a plurality of positions though assumes eight positions in this embodiment). This convex part is formed with the protrusion which projects in a vertical direction in figure. The length of the convex part can be adjusted by cutting. Thus, narrow portion passage 63 is formed with narrow portion 35 on the entrance side of the space part. The length can be adjusted. Moreover, fuel heating space channel 64 blocked by narrow portion 35 is formed on the exit side of the space part. Convex part 37 is blocked as shown in FIG. 5, and only narrow portion passage 63 leads to the fuel heating space channel. Narrow portion passage 63 and fuel heating space channel 64 are on the same plane. Moreover, fuel heating space channel 64 has small protruding portion 65 which reaches the convex part. In addition, horizontal passage 33 where the swirl is formed to the fuel is formed on the maximum end face. Substantially circumferential fuel heating space channel 64 where the entrance side is blocked except narrow portion passage 63 is formed in fuel passage 60 by narrow portion 35. The capacity of fuel heating space channel 64 is adjusted by the length of convex part 37, that is, the length of narrow portion 35, to provide heater 40 in it. Heater 40 may be arranged to contact swirl chip 30 or cylinder 10 in the fuel heating space channel. However, the heat from heater 40 can be transferred effectively and promptly by separating it from the cylinder as shown in figure.

The capacity of fuel heating space channel 64 is the capacity which corresponds to one fuel injection to the engine. The fuel of the proper quantity is heated effectively and promptly to supply and inject to the engine by making to this capacity.

Convex part 37 may be formed inside of casing 10 though convex part 37 is formed on swirl chip 30 in this example. Moreover, a ring-like member may be inserted between swirl chip 30 and casing 10 as a convex member. Because it is used in one body combined with swirl chip 30, it can be thought a s a part of swirl chip 30 though a separated member is used in the example.

Heater 40 is set up and supported in the fuel passage by eight convex parts 37 of swirl chip 30 as mentioned above. Thus, the calorie transferred from heater 40 to swirl chip 30 by supporting the heater with the smallest contact area possible is decreased, and the fuel can be heated effectively. This contributes to the temperature rise for a short time and the power saving. As a result, the atomization can be performed stably from the engine starting.

Heater 40 is arranged in fuel passage 60 (fuel heating space channel 64) between swirl chip 30 and casing 10. Therefore, fuel passage 60 is narrowed for swirl chip 30, and the fuel can be concentrated around heater 40. The heat from heater 40 is transferred to the fuel by heat conduction without relying on convection, and as a result, the entire fuel can be heated at high speed. In addition, because swirl chip 30 exists between heater 40 and plunger 20, it is not easy to transfer heat to plunger 20. Therefore, the thermal deformation of plunger 20 can be prevented, and the atomization is performed stably. In addition, plunger 10 can move because the hole through which plunger 10 extends is expanded even if swirl chip 30 is heated with heater 40. Therefore, there is no problem even if plunger 10 is heated with heater 40.

It is preferable to provide the clearance between Nichrome wires of the heater to promote the heat transfer to the fuel further by a Nichrome wire heater. When the coil pitch interval of the Nichrome wire is 1.5 times the Nichrome wire diameter, the space of one second of diameters can be made between Nichrome wires. As a result, a minute swirl can be caused in the fuel because of the Nichrome wire, and the surface area of the Nichrome wire can be maximized. If the clearance is smaller than that, the Nichrome wires interfere mutually and the efficiency of the heat transmission decreases if the clearances are larger than that, the occupation capacity of the Nichrome wire heater increases and the installing worsens. A cylinder heater may be used though the Nichrome wire heater is used in this example.

One end of wiring 125 for heater 40 is inserted in swirl chip 30. The other edge is drew out from the hole in casing 10 through the groove provided in swirl chip 30, and extended along the groove provided in the fuel injection valve. The wiring is drew into the inside through molding hole 124 from resin molding 123 again, and connected with driving terminal 120 for the heater. In this case, the hole of each part is closed with the heatproof insulation adhesive to prevent the fuel leakage. A swirl penetration hole may be used in place of the swirl chip groove.

As for swirl chip 30, the passage with the effect of the swirl is provided in horizontal passage 33 on the face which contacts orifice member 50 as shown in FIG. 6 in detail. Though the atomization is promoted by swirl chip 30, the effect is weakened at starting when the fuel pressure is low. Even at starting when the fuel pressure is low and the effect of the swirl is weak, the fuel can be atomized by heating the fuel using a heating type fuel injection valve. Therefore, the atomization can be obtained stably from the starting point. Moreover, even if the heating action is not used enough after starting, the atomization can be performed enough by the atomization action of the fuel injection valve with swirl chip 30. As a result, the electric power consumption can be decreased.

In addition, details of swirl chip 30 and the fuel channel formed by swirl chip 30 are explained. A plurality of narrow portions 35 is provided on the upstream side of swirl chip 30 in the upper part of the heater 40 (fuel inflow side) as mentioned above. Thereby, the flow of the fuel is straightened by narrow portion 35, and the speed of the fuel is increased. And, the fuel is introduced into the closed fuel heating space channel 64 where heater 40 is provided. Therefore, the heat transfer from heater 40 to the fuel can be increased during the injection of the fuel. Moreover, because the fuel in the heater surroundings keeps flowing by the inertia of the fuel even if the fuel injection is interrupted, the heat transfer to the fuel is promoted.

Figure 12:
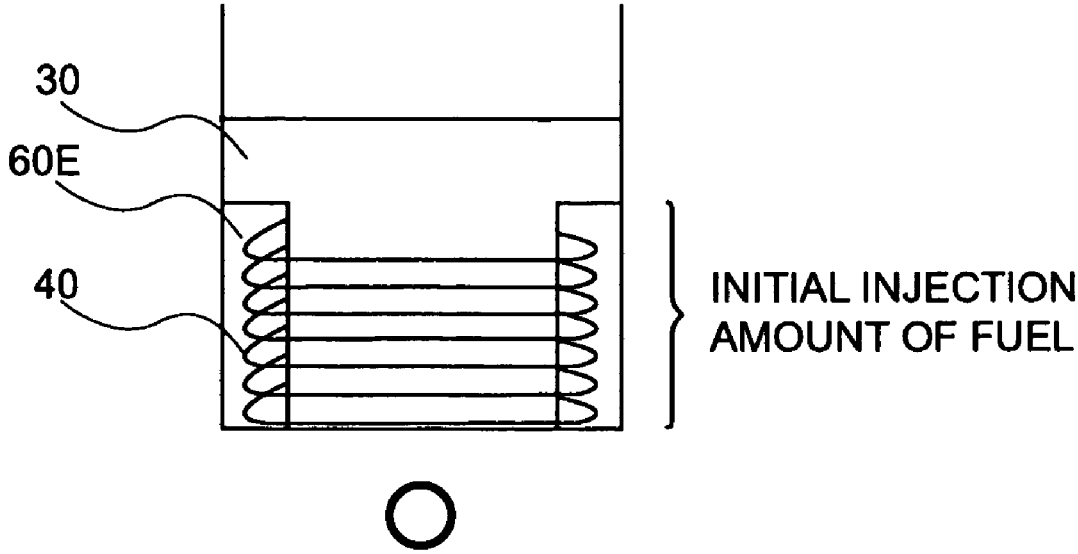
FIG. 12 is a desirable example of the heater arrangement.
Figure 13:
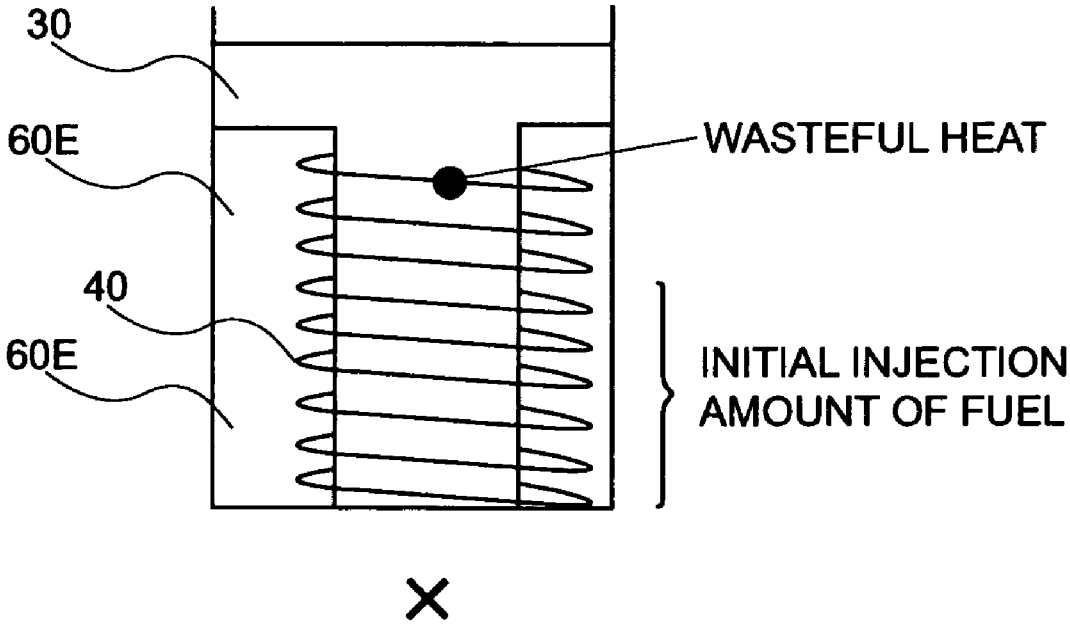
FIG. 13 is an undesirable example of the heater arrangement.

Moreover, the capacity of fuel heating space channel 64 formed by swirl chip 30 and casing 10, and swirl chip 30 and orifice member 50 at the point of fuel injection valve 1 of the heating type is equal to the capacity of fuel injection amount required to one combustion of the engine or smaller than that. That is, the capacity corresponds to an amount of fuel injection. One combustion mentioned here means one combustion stroke of each cylinder. FIG. 12 and FIG. 13 show the relationship of the capacity of the fuel in one combustion and the position of heater 40.

FIG. 12 shows the situation that heater 40 is soaked to one combustion amount of the fuel. By making like this, only one combustion amount of the fuel is mainly heated, and the heating for an extra fuel is not required. Therefore, the electric power consumption can be decreased, and the fuel can be heated at high speed.

In addition, the controllability when the heating is discontinued/restarted is improved because one combustion amount of the fuel is heated every time. Of course, it is desirable that heater 40 is arranged at the position where the fuel is less than one combustion amount.

Even if the electric power of the same size is given to the heater when the heater is not soaked to one combustion amount of the fuel as shown in FIG. 13, the heating which corresponds to one combustion cannot be performed. The heater should be arranged at the position which corresponds to the fuel capacity less than one combustion to decrease the electric power consumption as shown in FIG. 12.

Figure 10:
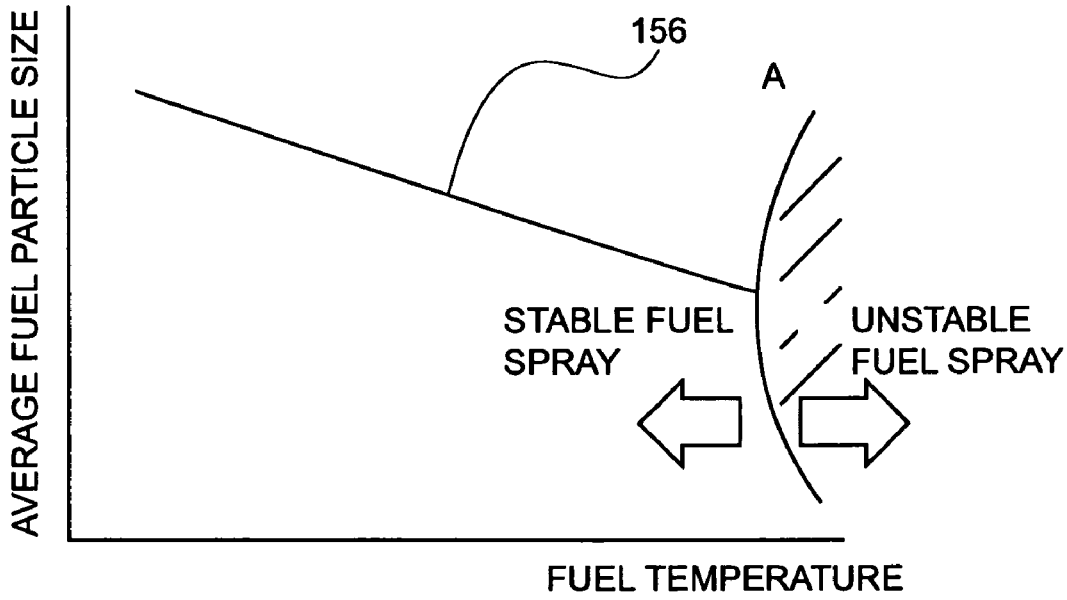
FIG. 10 is a view showing the relationship between fuel temperature and mean atomized particle diameter.
Figure 11:
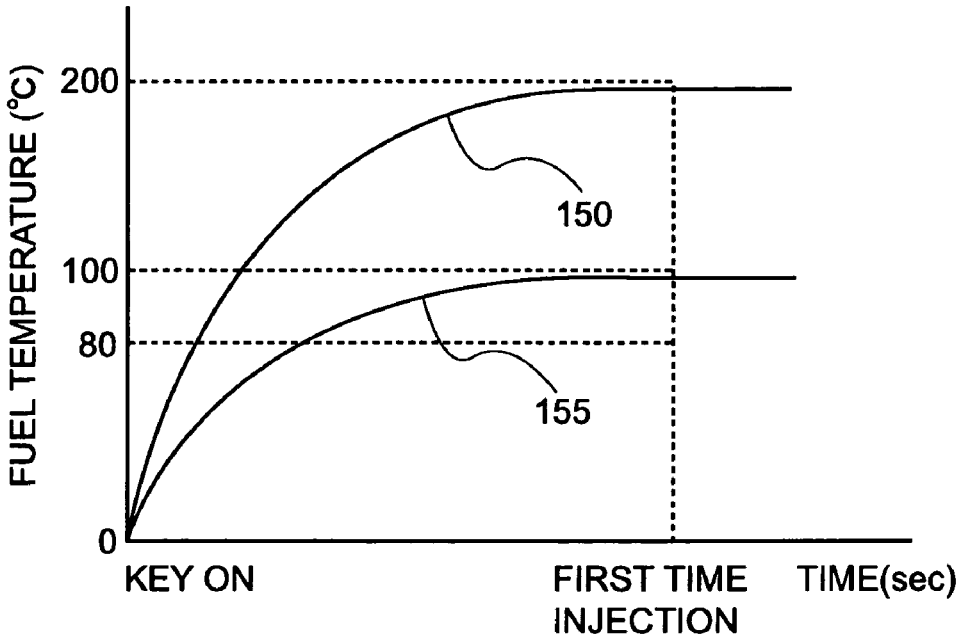
FIG. 11 is a view showing fuel and heater temperature rise.

The pattern of the temperature rise of Fuel and heater 40 when fuel injection valve 1 of the heating type according to this embodiment shown in FIG. 2 is used is shown in FIG. 11. Two solid lines indicates heater temperature rise line 150 showing the rise of th e temperature of the heater and fuel temperature rise lines 155 showing the temperature rise of the fuel. The temperature of the heater is obtained by measuring the electric resistance of the heater. Moreover, the temperature of the fuel is obtained by measuring the temperature of the fuel in the downstream of the injection port by a thermocouple. Numeral 0 shown in the quadrature axis of the figure indicates a key-on time. The temperature of the fuel reaches 80° C.-100° C. and the temperature of the heater approaches 200° C. in 0.5 seconds from the start of the cranking to the first time injection. However, the temperature of the fuel does not exceed 100° C. There is a possibility that percolation is generated when this temperature is 100° C. or more as understood from relation line 156 of the temperature of the fuel and the mean atomized particle diameter shown in FIG. 10. In such a situation, the difference increases as for both injection amount and the mean atomized particle diameter, and the combustion control of the engine becomes difficult. The mean atomized particle diameter is related to the surface tension of the fuel. The decrease rate of the atomized particle size changes linearly with respect to the decrease rate of the surface tension caused by raising the temperature of the fuel (surface tension $\propto$ atomized particle size). However, when the temperature of the fuel is 80° C. or less, the atomization is not promoted sufficiently, and a lot of hydrocarbon elements is emitted from the exhaust gas. Therefore, the temperature of the fuel is most preferable in the range of 80° C.-100° C. Accordingly, mean particle size 20 μm of a particle suitable for excellent atomization, that is, for the fuel is obtained by raising the temperature like the embodiment.

It is preferable to make the temperature of the fuel to set to 80° C.-100° C. even when the temperature of the heater is 200° C. or less, in consideration of the temperature of the fuel in the neighborhood of the heater from the durability of the heater, that is, the stress generated by the thermal expansion and the duration of life of the insulated coating.

Figure 7:
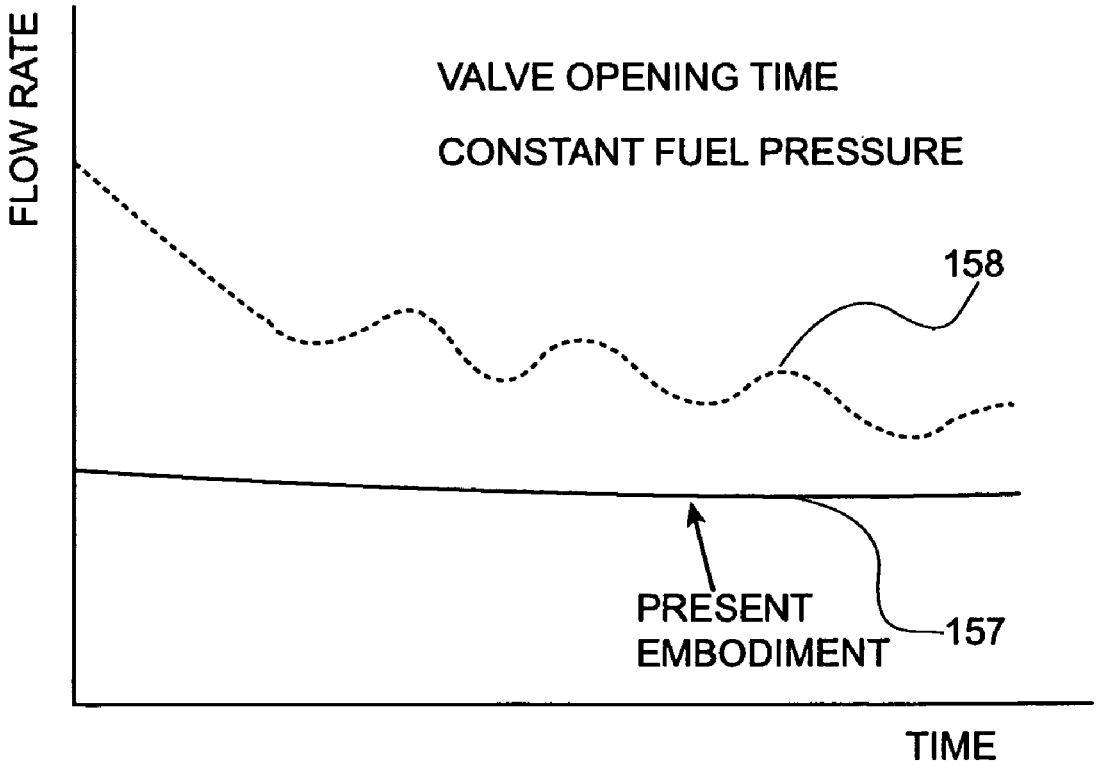
FIG. 7 is a view showing the fuel flow after an engine starts.

FIG. 7 shows the fuel injection result. The longitudinal axis indicates the injection fuel flow rate when the time of an open valve and fuel pressure are assumed to be constant, and the quadrature axis indicates time. Solid line 157 indicates the fuel flow rate in this embodiment, and it is constant. Solid line 158 indicates the fuel flow rate when the temperature of the fuel is 200° C. or more, the fuel flow rate is not constant compared with the above.

Figure 8:
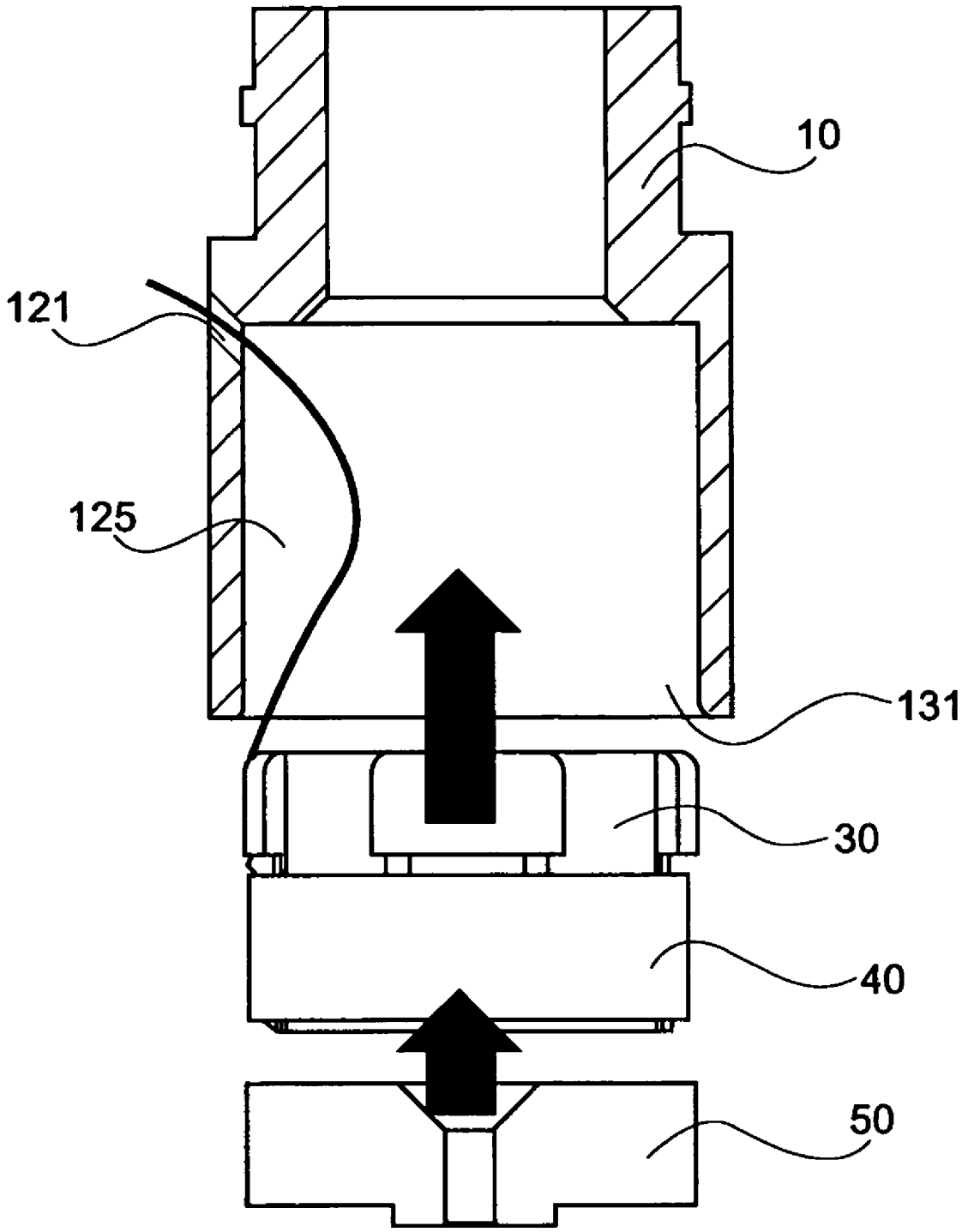
FIG. 8 is a view showing an assembly method.
Figure 9:
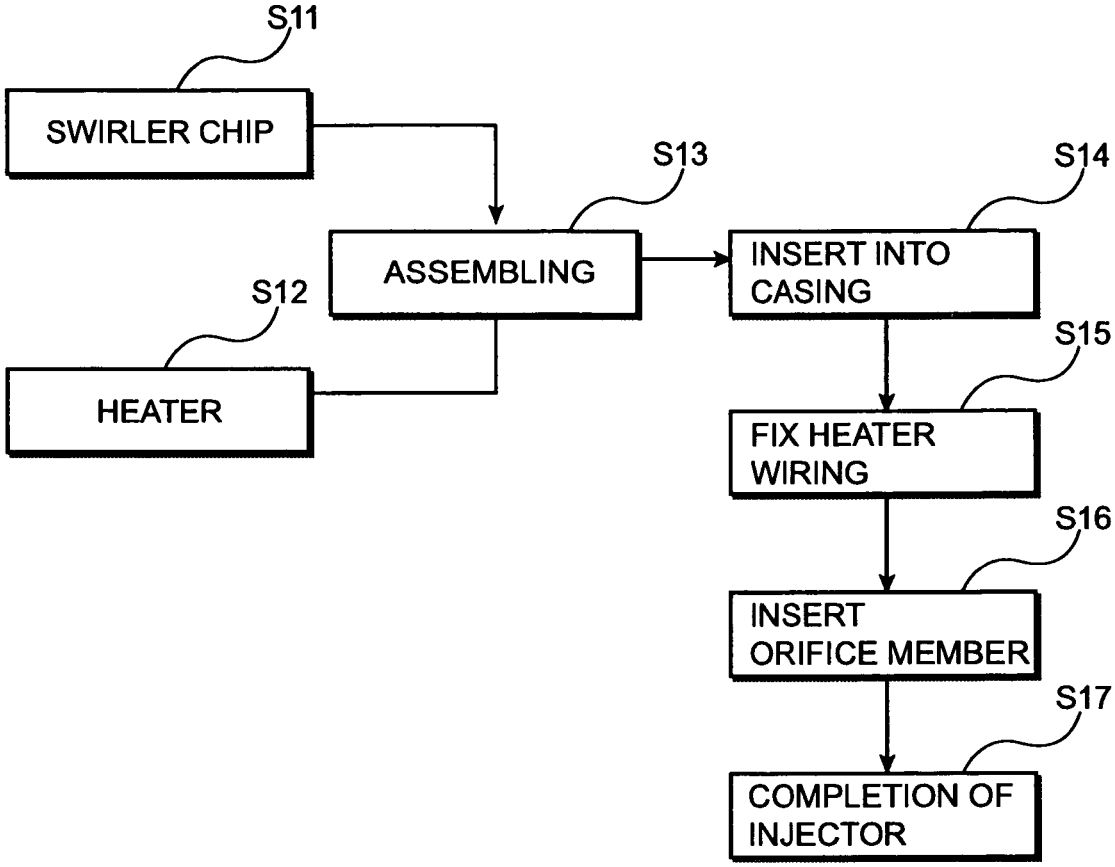
FIG. 9 is a view showing assembly steps.

FIG. 8 and FIG. 9 show one example of an assembly method of the heating type fuel injection valve.

The assembly method is as follows.

The edge of casing 10 is formed as open end 131 and casing hole 121 as the penetration hole is formed in a part of the casing.

Narrow portion 35 which narrows the fuel passage is formed to swirl chip 30 on the entrance side of fuel passage 60, and fuel heating space channel 64 is formed, where the entrance side is blocked by narrow portion 35 except narrow portion passage 63. Swirl chip 30 is formed like this. (S11)

Swirl chip 30 is installed at the position where it was made to come to the surface internally in fuel heating space channel 64, namely, heater 40 is installed on the convex swirl chip groove and assembled. (S12, S13)

Wiring 125 for heater 40 (lead wire) is penetrated to casing hole 121, and swirl chip 30 is inserted into casing 10 through open end 131, and set up. (S14)

The heater wiring is fixed. (S15)

Then, orifice member 50 is inserted into casing 10 through open end 131 until it contacts swirl chip 30, and fixed to casing 10. That is, orifice member 50 is inserted. (S16)

Fuel injection valve 1 (injector) is completed. (S17)

Fuel passage 60 where narrow portion passage 63 and fuel heating space channel 64 are provided can be formed by making between casing 10 and swirl chip 30 as described above.

In this assembly method, swirl chip 30 and heater 40 combined beforehand is inserted into casing 10. In this embodiment, one end of the wiring for the heater is soldered with swirl chip 30. The other end of the wiring is fixed with solder through the hole made for casing 10. The combined member is welded to orifice member 50 and casing 1 after it is inserted in the casing, and assembled. The positioning accuracy of heater 40 is improved by assembling in advance, and when mass-producing it, heating type fuel injection valves with few solid differences can be made. Moreover, the inspection of the heater is easy even if the fuel injection valve is not completed, and the yield is improved because swirl chip 30 and the heater are combined in advance, which are the fuel passage forming members. The heat transfer and the heat conduction from the heater to swirl chip 30 change according to how to install when heater 40 and swirl chip 30 are combined, and the temperature rise performance of the heating type fuel injection valve might vary. An inferior heater can be excluded by assembling the heater in advance before the heating type fuel injection valve is completed, because the temperature rise in the state of the heater assembly can be measured.

Moreover, because the outermost diameter of swirl chip 30 increases more than the outermost diameter of heater 40, swirl chip 30 functions as a protection member to fragile heater 40, and assembly becomes easy further.

In the above-mentioned embodiment, the injection port was one.

Figure 14:
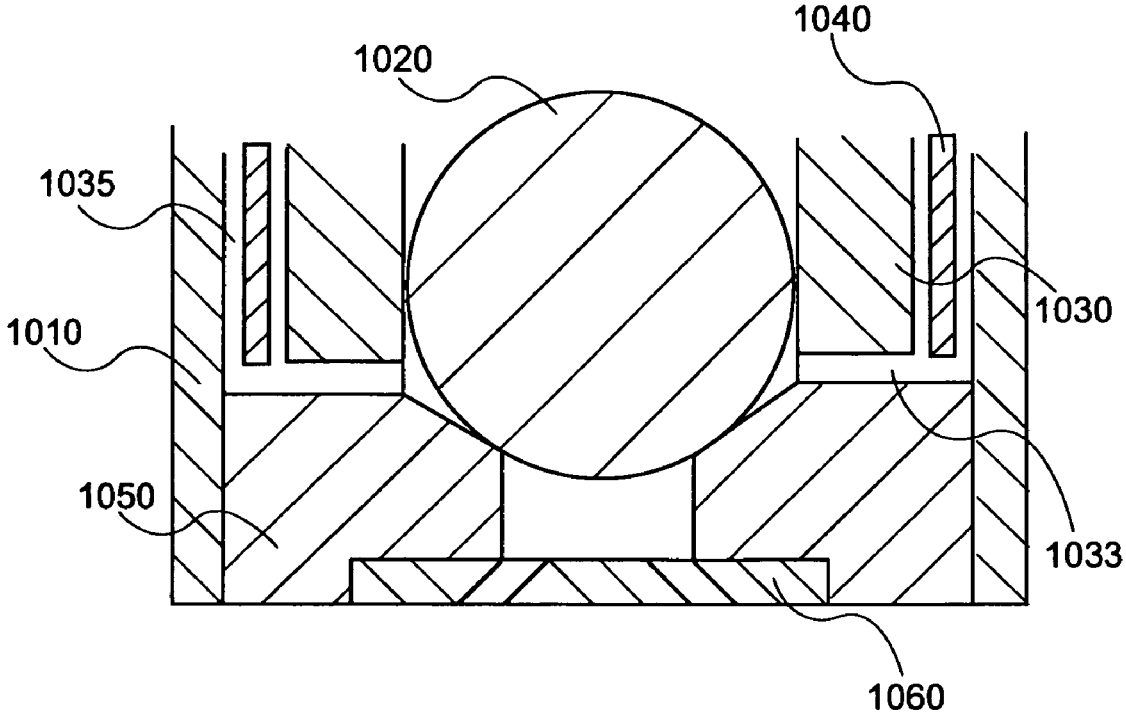
FIG. 14 is a view showing the top of a heating type fuel injection valve with a plurality of injection ports.

However, it is also easy to apply to a heating type fuel injection valve 1 with plural injection ports. FIG. 14 shows one example of such injection valves. The point of the fuel injection valve is comprised of casing 1010, plunger 1020, fuel passage forming member 1030, horizontal passage 1033, fuel passage 1035, heater 1040, orifice member 1050, and porous plate 1060. Each positional relationship is as follows. Orifice member 1050 with an orifice which the fuel passes through and plunger 1020 which opens or shuts orifice member 1050 are arranged in casing 1010. Moreover, fuel passage forming member 1030 which contacts the orifice member 1050 and casing 1010 and forms the fuel passage with contact side with them is provided in the point of the fuel injection valve. Heaters 1040 are supported by either of fuel passage forming member 1030 or casing 1010 at a plurality of positions. Horizontal passage 1070 is provided in the plane which contacts orifice member 1050 in fuel passage forming member 1030. Porous plate 1060 is provided at the position where it contacts orifice member 1050 and the fuel is injected. When plunger 1020 which seats usually on orifice member 1050 is lifted up by energizing, and it contacts heater 1040 arranged in fuel passage 1035, the fuel is heated. The heated fuel passes orifice member 1050, and is injected in porous plate 1060.

Because heater 1040 is supported at a plurality of positions in the fuel passage, the heat of heater 1040 is effectively transferred to the fuel. Heater 1040 is arranged in fuel passage 1035 between fuel passage forming member 1030 and casing 1010. Therefore, fuel passage 1035 is narrowed only for fuel passage forming member 1030, and the fuel can be concentrated around heater 1040. As a result, heating the entire fuel at high speed becomes possible. A power saving type fuel injection valve in which the temperature rise of the fuel is fast can be obtained by two effects. In addition, because fuel passage forming member 1030 exists between heater 1040 and plunger 1020, it is not easy to transmit to plunger 1020 in heat. Therefore, the thermal deformation of plunger 1020 can be prevented, and the atomization is performed stably. Moreover, because the fuel in the neighborhood of porous plate 1060 can be heated, the atomization can be performed stably from the engine starting point of time.

At the starting in which the fuel pressure is low and the effect of porous by porous plate 1060 is weak, the fuel can be atomized by heating. In addition, even if the heating action is not used enough after the engine is started, enough atomization can be achieved with porous plate 1060. As a result, the electric power consumption can be decreased.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

What is claimed is:

1. A fuel injection valve for an engine comprising:

a casing, an orifice member provided in the casing to form an orifice which the fuel passes through, a plunger which opens or shuts said orifice, and a fuel passage forming member provided in said casing, which faces said casing, contacts said orifice member, and forms a fuel passage along said casing;

wherein said casing or said fuel passage forming member has a narrow portion, which narrows the fuel passage, upstream of said fuel passage, wherein a fuel heating space channel with an entrance side that is blocked, except for a narrow portion passage, is formed in said fuel passage, and wherein a heater is provided in the fuel heating space channel downstream of the narrow portion.

2. The fuel injection valve for an engine according to claim 1, wherein said narrow portion has a circumference part to narrow said fuel passage over its periphery and a convex part provided at a plurality of positions of a circumference part to contact said casing.

3. The fuel injection valve for an engine according to claim 1, wherein said heater is provided in said fuel heating space channel so as to come from the surface of the member which forms said casing and said fuel passage to the surface.

4. The fuel injection valve for an engine according to claim 3, wherein said narrow portion has a circumference part to narrow said fuel passage over its periphery and a convex part provided at a plurality of positions of a circumference part to contact the opposing part, and wherein said heater is penetrated to the hole or slot provided in the convex part, and supported.

5. The fuel injection valve for an engine according to claim 1, wherein the member which forms said fuel passage is a swirl chip which has a swirl means for fuel.

6. A fuel injection method for an engine using a fuel injection valve for an engine comprising a casing, an orifice member provided in the casing to form an orifice through which the fuel passes, a plunger which opens or shuts said orifice, a fuel passage forming member provided in said casing, which faces said casing, contacts said orifice member, and forms a fuel passage along said casing, and a fuel heating space channel formed in said fuel passage, which has the capacity which corresponds to one shot of the fuel injection to the engine and with an entrance side that is blocked, except for a narrow portion passage, is formed in said fuel passage;

wherein the fuel heated by the heater provided in the fuel heating space channel is supplied and injected into the engine.

7. The fuel injection method for an engine using a fuel injection valve for an engine according to claim 6, wherein the capacity of said fuel heating space channel is adjusted by adjusting the length of the passage of said narrow portion.

8. The fuel injection method for an engine using a fuel injection valve for an engine according to claim 6, wherein the temperature of the fuel is increased to 80°-100° by said heater provided in said fuel heating space part so as to come to the surface internally.

* * * * *